US007443378B2

(12) United States Patent
Moon

(10) Patent No.: US 7,443,378 B2
(45) Date of Patent: Oct. 28, 2008

(54) DRIVING APPARATUS OF ELECTRONIC INK DISPLAY DEVICE AND METHOD THEREFOR

(75) Inventor: Seong-Hak Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 689 days.

(21) Appl. No.: 10/988,589

(22) Filed: Nov. 16, 2004

(65) Prior Publication Data

US 2005/0104845 A1 May 19, 2005

(30) Foreign Application Priority Data

Nov. 17, 2003 (KR) ..... 10-2003-0081160
Nov. 17, 2003 (KR) ..... 10-2003-0081161

(51) Int. Cl.
*G09G 3/34* (2006.01)

(52) U.S. Cl. ..... 345/107; 345/100

(58) Field of Classification Search ..... 345/104–107, 345/88–100, 204
See application file for complete search history.

(56) References Cited

U.S. PATENT DOCUMENTS 6,592,044 B1 * 7/2003 Wong et al. ..... 235/493
2003/0082889 A1 * 5/2003 Maruyama et al. ..... 438/455
2006/0187187 A1 * 8/2006 Johnson et al. ..... 345/107

FOREIGN PATENT DOCUMENTS

KR 10-2003-0044170 6/2003

* cited by examiner

*Primary Examiner*—Nitin Patel
(74) *Attorney, Agent, or Firm*—Ked & Associates, LLP

(57) ABSTRACT

Disclosed are a driving apparatus of a passive matrix type electronic ink display device capable of driving the electronic ink display device precisely, improving a contrast of data displayed in the electronic ink display device, and simplifying a manufacturing process according to a simple construction of the electronic ink display device, and a method therefor. For this purpose, the method for driving the electronic ink display device comprises the steps of: applying a data voltage to at least one data line among a plurality of data lines; and applying a scan voltage only to one scan line selected among a plurality of scan lines while the data voltage is applied, and then floating the remaining scan lines other than the selected scan line.

35 Claims, 6 Drawing Sheets

DRIVING APPARATUS OF ELECTRONIC INK DISPLAY DEVICE AND METHOD THEREFOR

BACKGROUND OF THE INVENTION

1. Field of the Invention

The present invention relates to an electronic ink display device, and particularly, to a driving apparatus of a passive matrix type electronic ink display panel and a driving method therefor.

2. Description of the Prior Art

A digital paper display device is being developed as a next generation display device to follow a liquid crystal display device, a plasma display panel, and an organic electro luminescent display device. In particular, an electronic paper using an electronic ink is expected to be a material for replacing the existing printing media such as books, newspapers, magazines, or the like. A display device using the electronic ink is based on an electrophoresis which adds an electric field to a conductive material to allow the material to have a motility, which may be referred to as an electrophoretic display device.

The electronic ink display device distributes particles having a conductivity between thin type flexible substrates and then displays data as a direction setting variation of the particles based on a polarity variation of the electric field. As stated above, the electronic ink display device is a core device for embodying a flexible (or paper) display device because the device can be created by a flexible substrate.

Once creating the electronic ink display device in a form of panel by using a substrate of a flexible material, the electronic ink display device can be created flexibly, and also can be easily carried by constructing it in a thin type. Furthermore, the electronic ink display device has a simple electrode structure, and its manufacturing process is also simple, thereby producing it with low costs. The electronic ink display device is easy to scale it up, and consumes a small amount of power because of not using a back light. On the other hand, the electronic ink display device delays a response time because data is displayed depending on motions of particles. As a result of this, it is not suitable to embody a moving image. The electronic ink display device also has a limitation to represent a full color and a gradation.

Hereinafter, it will be explained of an architecture of the electronic ink display device and an operating principle thereof, and a driving apparatus of a passive matrix type display device and a method therefor with reference to FIGS. 1 to 4.

FIG. 1 is a sectional view showing a cell of the electronic ink display device of the conventional art.

Referring to FIG. 1, the cell of the electronic ink display device of the conventional art includes: an upper substrate 10 and a lower substrate 80 made of plastic or glass; an upper electrode 20 placed at a lower surface of the upper substrate 10, for applying a driving voltage to a capsule 60 and a lower electrode 70 placed at an upper surface of the lower substrate 80, for applying the driving voltage to the capsule 60; and the capsule 60 placed between the upper electrode 20 and the lower electrode 70. Here, in the capsule 60, white pigment particles 30 and black pigment particles 50, and dielectric fluid 40 are encapsulated.

If an electric field is formed between the upper electrode 20 and the lower electrode 70 by applying a voltage to the upper electrode 20 and the lower electrode 70, such constructed cell can embody white and black colors by moving the black pigment particles and white pigment particles based on the formed electric field. That is, if a positive voltage is applied to the upper electrode 20 and a negative voltage is applied to the lower electrode 70, the white pigment particles 30 are attracted to the upper electrode 20 and the black pigment particles 50 are attracted to the lower electrode 70, and thereby the cell displays a white color. Contrarily, if the negative voltage is applied to the upper electrode 20 and the positive voltage is applied to the lower electrode 70, the white pigment particles 30 are attracted to the lower electrode 70 and the black pigment particles 50 are attracted to the upper electrode 20, and thereby the cell displays a black color.

FIG. 2 is a sectional view showing an RGB pixel of the electronic ink display device of the conventional art.

Referring to FIG. 2, one RGB pixel of the conventional art is comprised of respective three cells described in FIG. 1 as a sub-pixel. An R cell displays red, a G cell displays green and a B cell displays blue. Here, if a negative voltage is applied to an upper electrode 21 and a positive voltage to a lower electrode 71, a voltage is not applied to both an upper electrode 22 and a lower electrode 72. If a positive voltage is applied to an upper electrode 23 and a negative voltage is applied to a lower electrode 73, each cell will be operated as follows. Because the negative voltage is applied to the upper electrode 21, the black pigment particles ($M_{BL}$) in the R cell are attracted to the upper electrode 21. On the other side, because the positive voltage is applied to the lower electrode 71, the red pigment particles ($M_R$) in the R cell are attracted to the lower electrode 71, and thereby the R cell displays black. Furthermore, because the voltage is not applied to both the upper electrode 22 and the lower electrode 72, the green pigment particles ($M_G$) and the black pigment particles ($M_{BL}$) in the G cell may be mixed randomly, or maintain the existing state. Also, because the positive voltage is applied to the upper electrode 23, the blue pigment particles ($M_B$) in the B cell are attracted to the upper electrode 23, and because the negative voltage is applied to the lower electrode 73, the black pigment particles ($M_{BL}$) in the B cell are attracted to the lower electrode 73, and thereby the B cell displays blue.

At this time, each cell is sensitively reacted according to a size of voltage applied between the upper electrodes 21, 22 and 23 and the lower electrodes 71, 72 and 73. Thus, if a simple matrix driving method based on the conventional art is used, there may occur a difference in an amount of attracted pigments particles and a moved speed of the pigment particles.

Hereinafter, it will be explained of an operation of the electronic ink display device when the simple matrix driving method based on the conventional art is used for a passive matrix type electronic ink display device with reference to FIGS. 3 and 4.

FIG. 3 is a waveform diagram showing a voltage applied to the passive matrix type electronic ink display device to which the simple matrix driving method based on the conventional art is applied.

Referring to FIG. 3, according to the simple matrix driving method based on the conventional art, a scan pulse which is varied from a predetermined negative voltage $-V_s$ to a ground voltage 0V is applied to a cell connected to a first scan line $SL_1$ in a display panel (not shown) in which a plurality of data lines $D_1$~$D_m$ and a plurality of scan lines $SL_1$~$SL_n$ are constructed in a matrix type. Then, while the scan pulse is applied, a data pulse of a predetermined positive voltage $V_D$ is applied to data lines selected among the plurality of data lines constructed in the display panel, thereby operating cells. Furthermore, the ground voltage 0V is applied to the remaining scan lines without the scan pulse applied, which processes are executed for every scan lines. Thereafter, once all cells are operated, a reset pulse of a predetermined negative voltage $-V_r$ is applied to all of the data lines $D_1$~$D_m$. As a result of this, the display panel becomes a black state.

However, unlike existing display devices, because there is not any threshold voltage in the electronic ink display device, there can occur a problem that the color pigment particles in the capsule can be moved due to somewhat voltage applied even to a cell which should not be driven. Therefore, the electronic ink display device can not be passively driven by the simple matrix driving method based on the conventional art.

Now, it will be explained of problems when the simple matrix driving method based on the conventional art is applied to the electronic ink display device with reference to FIG. 4.

FIG. 4 is a wave form diagram showing a voltage applied to a cell during a time A shown in FIG. 3.

Referring to FIG. 4, a driving voltage $V_a$ is applied to cells of a first scan line $SL_1$ to which a data pulse and a scan pulse are simultaneously applied to be operated normally. However, a voltage lower than the predetermined voltage $V_a$ (applied to the cells of the first scan line $SL_1$) is applied to cells (to which the data pulse is applied but the scan pulse is not) of the remaining scan lines $SL_2$~$SL_n$. Therefore, the color pigment particles in the capsule of the cell are slowly moved within the capsule. As a result, because a voltage representing a data signal is applied to a scan electrode of another cell other than a cell to be driven, the electronic ink display device can not be driven normally when using the simple matrix driving method based on the conventional art therefor.

As aforementioned, when applying the simple matrix driving method based on the conventional art to the electronic ink display device, unlike existing display devices, because there is not a threshold voltage which determines whether to drive a cell in the electronic ink display device, a voltage having a smaller value than a predetermined value applied to the data lines is applied to cells other than the cell to be driven. As a result, there can occur a problem that other cells except the cell to be driven may be also driven.

Due to those problems, an active matrix type electronic ink display device is being developed. However, the active matrix type electronic ink display device has a complicated manufacturing process and a complicated driving method therefor, and consumes a large amount of power, comparing to the passive matrix type electronic ink display device.

SUMMARY OF THE INVENTION

Therefore, an object of the present invention is to provide a driving apparatus of an electronic ink display device and a method therefor capable of driving a passive matrix type electronic ink display device precisely, of improving a contrast for the electronic ink display device, and of reducing power consumption thereof, by applying a data voltage to at least one data line among a plurality of data lines, applying a scan voltage only to one scan line selected among a plurality of scan lines while the data voltage is applied, and floating the remaining scan lines other than the one selected scan line.

To achieve these and other advantages and in accordance with the purpose of the present invention, as embodied and broadly described herein, there is provided a driving method for an electronic ink display device, comprising the steps of: applying a data voltage to at least one data line among a plurality of data lines; and applying a scan voltage only to one scan line selected among a plurality of scan lines while the data voltage is applied.

According to another embodiment of the present invention, there is provided a driving method for an electronic ink display device, comprising the steps of: applying a data pulse to at least one data line among a plurality of data lines, and applying a ground voltage or a scan pulse only to one scan line selected among a plurality of scan lines while the data pulse is applied; and simultaneously applying a frame reset pulse to the plurality of data lines, simultaneously applying the ground voltage to the plurality of scan lines while the frame reset pulse is applied or applying the frame reset pulse to the plurality of scan lines, and simultaneously applying the ground voltage to the plurality of data lines while the frame reset pulse is applied.

To achieve these and other advantages and in accordance with the purpose of the present invention, as embodied and broadly described herein, there is provided a driving apparatus of an electronic ink display device, comprising: an electronic ink display panel including a plurality of scan lines and a plurality of data lines; a scan driving unit applying a ground voltage only to a scan line selected among the plurality of scan lines in a floating state; and a data driving unit applying a data pulse of a predetermined positive voltage, a ground voltage or a frame reset pulse of a predetermined negative voltage to the plurality of data lines.

According to another embodiment of the present invention, there is provided a driving apparatus of an electronic ink display device, comprising: an electronic ink display panel including a plurality of scan lines and a plurality data lines; a data driving unit applying a data pulse of a predetermined positive voltage or a ground voltage to the plurality of data lines; and a scan driving unit applying a scan pulse of a predetermined negative voltage, a scan line reset pulse of a first predetermined positive voltage, or a frame reset pulse of a second predetermined positive voltage only to a scan line selected among the plurality of scan lines in a floating state.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

It will be described about preferred embodiments with respect to a driving apparatus of an electronic ink display device and a method therefor, with reference to FIGS. 5 to 10, in which a potential difference is generated at a cell to display data to form a electric field in a passive matrix type electronic ink display device, and the remaining cells (namely, cells not to display data) are floated, thereby displaying data of a frame in the electronic ink display device, and thereafter all cells on the electronic ink display device are reset to driving the electronic ink display device precisely. Additionally, in the preferred embodiments related to the electronic ink display device, for a convenient explanation, when a cell indicates data, it is displayed as white, and when a cell does not indicate data, it is displayed as black (namely, refer to as a black state).

Hereinafter, it will be explained of a first embodiment for a driving apparatus of an electronic ink display device and a method therefor in accordance with the present invention with reference to FIGS. 5 to 7.

Figure 1:
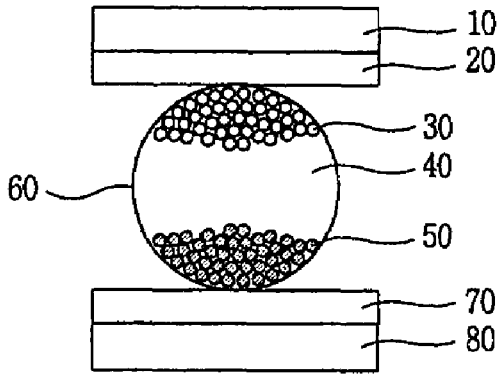
FIG. 1 PRIOR ART
FIG. 1 is a sectional view showing a cell of an electronic ink display device based on the conventional art.
Figure 2:
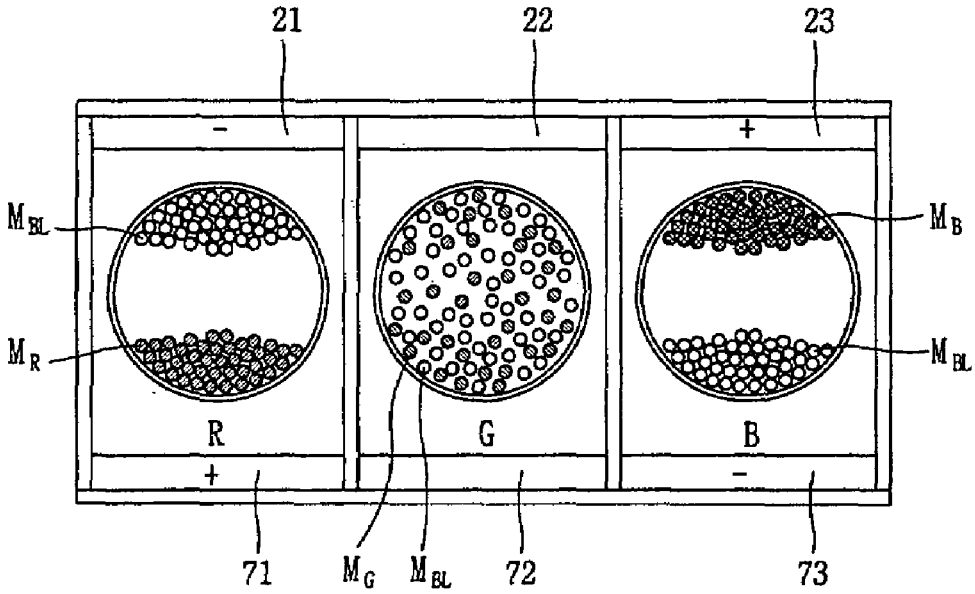
FIG. 2 PRIOR ART
FIG. 2 is a sectional view showing an RGB pixel of the electronic ink display device based on the conventional art.
Figure 3:
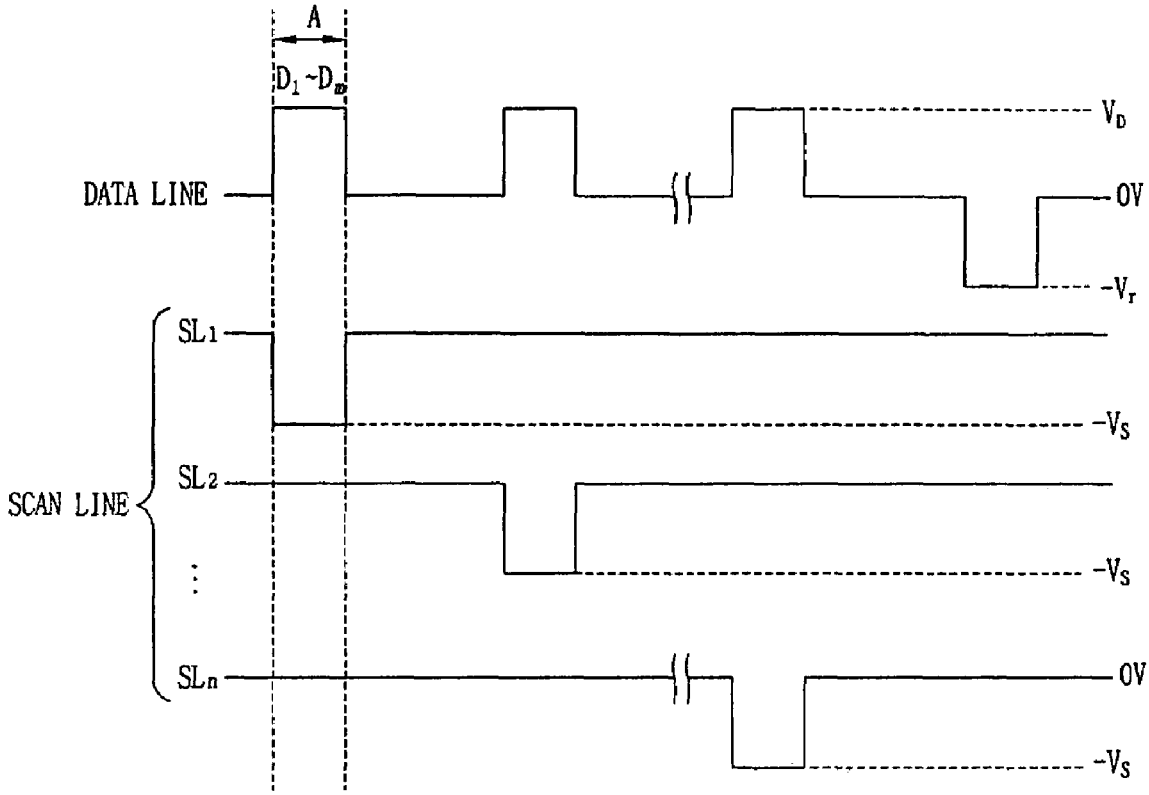
FIG. 3 PRIOR ART
FIG. 3 is a waveform diagram showing a voltage applied to a passive matrix type electronic ink display device to which a simple matrix driving method based on the conventional art is applied.
Figure 4:
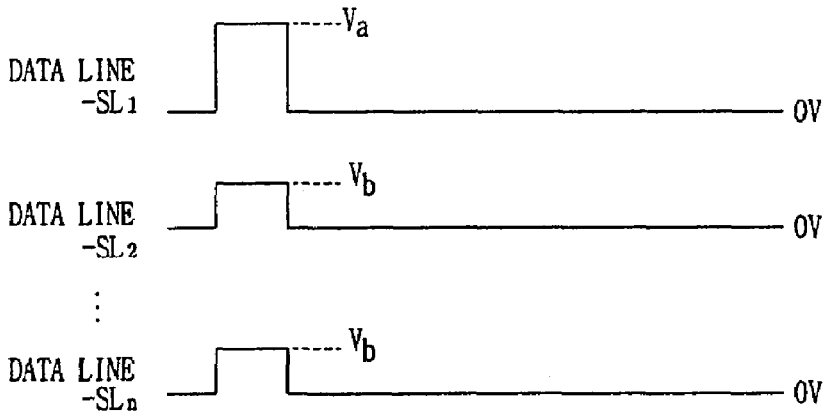
FIG. 4 PRIOR ART
FIG. 4 is a waveform diagram showing a voltage applied to a cell during a time A shown in FIG. 3.
Figure 5:
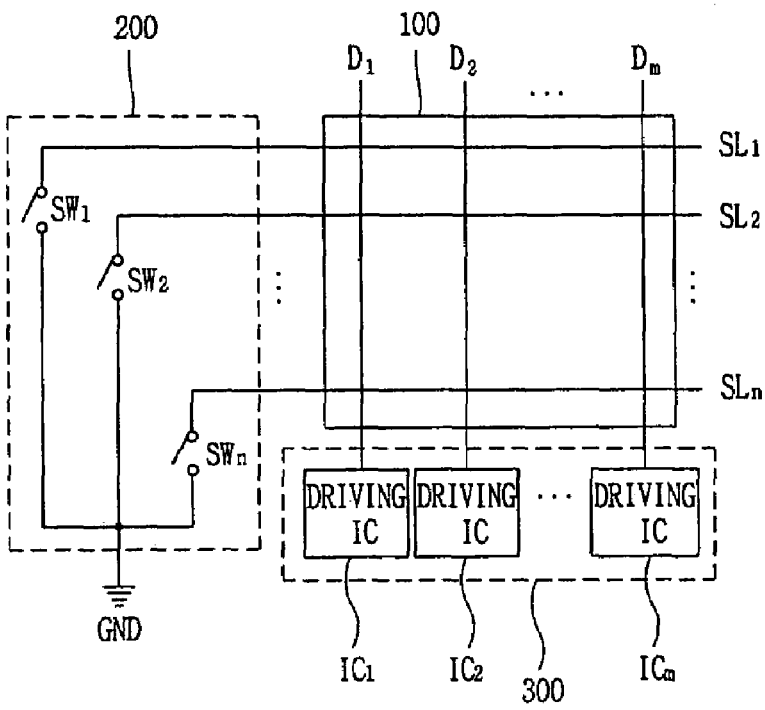
FIG. 5 is a schematic diagram showing an electronic ink display device in accordance with a first embodiment for a driving apparatus of the electronic ink display device and a method therefor according to the present invention.

FIG. 5 is a schematic diagram of the electronic ink display device in accordance with the first embodiment for the driving apparatus of the electronic ink display device and the method therefor according to the present invention.

Referring to FIG. 5, the driving apparatus of the electronic ink display device according to the present invention is comprised of: an electronic ink display panel 100 including a plurality of scan lines $SL_1$~$SL_n$ and a plurality of data lines $D_1$~$D_m$, cells of the electronic ink display device being respectively placed at positions where the plurality of data lines $D_1$~$D_m$ and the plurality of scan lines $SL_1$~$SL_n$ are perpendicularly crossed to each other; a scan driving unit 200 including a plurality of switching means $SW_1$~$SW_n$, for applying a ground voltage GND only to a scan line selected among the plurality of scan lines $SL_1$~$SL_n$ in a floating state; and a data driving unit 300 including a plurality of driving ICs $IC_1$~$IC_m$, for applying a data pulse of a predetermined positive voltage $V_D$ or a frame reset pulse of a predetermined negative voltage $-V_F$ to the plurality of data lines $D_1$~$D_m$.

It will now be explained of an operation of the plurality of driving ICs $IC_1$~$IC_m$ constructing the data driving unit 300 with reference to FIG. 6 in detail.

Figure 6:
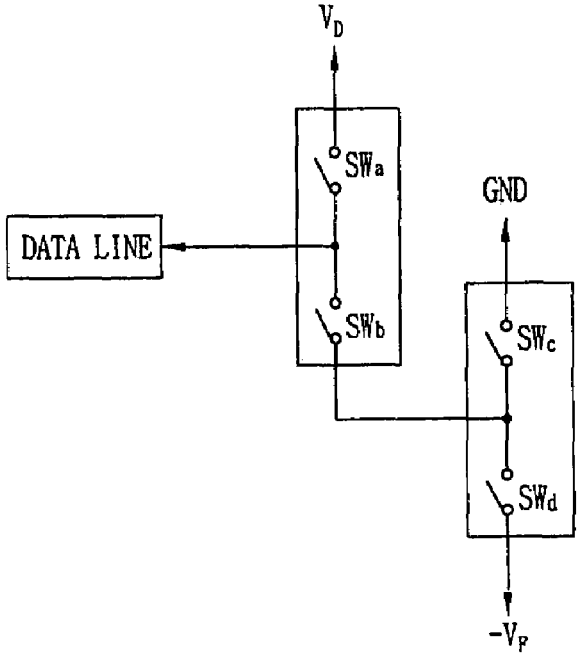
FIG. 6 is a schematic diagram showing an architecture of driving ICs ($IC_1$~$IC_m$) constructing a data driving unit 300 shown in FIG. 5.

FIG. 6 is a schematic diagram showing an architecture of the driving ICs ($IC_1$~$IC_m$) constructing the data driving unit 300 shown in FIG. 5.

Referring to FIG. 6, respective driving ICs $IC_1$~$IC_m$ constructing the data driving unit 300 include a plurality of switching means $SW_a$~$SW_d$. The plurality of switching means $SW_a$~$SW_d$ constructing the driving ICs $IC_1$~$IC_m$ are controlled by a switching control signal outputted from an external controller (not shown), and the plurality of switching means $SW_a$~$SW_d$ controlled by the control signal selectively output a data pulse of a predetermined positive voltage $V_D$ or a frame reset pulse of a predetermined negative voltage $-V_F$ to the data lines $D_1$~$D_m$ of the electronic ink display panel 100.

Here, the plurality of switching means $SW_1$~$SW_n$ constructing the scan driving unit 200 are also controlled by the switching control signal. Additionally, because the control signal inputted to each switching means $SW_1$~$SW_n$ of the scan driving 200 is basically an off-switching control signal, the scan lines $SL_1$~$SL_n$ connected to the scan driving unit 200 are in a floating state, and an on-switching control signal is inputted only to a selected switching means during a predetermined time to apply a ground voltage GND only to a scan line connected to the selected switching means.

Hereinafter, it will be explained of an operation of the driving apparatus of the electronic ink display device and the driving method therefor according to the present invention with reference to FIGS. 5 to 7 in detail.

Figure 7:
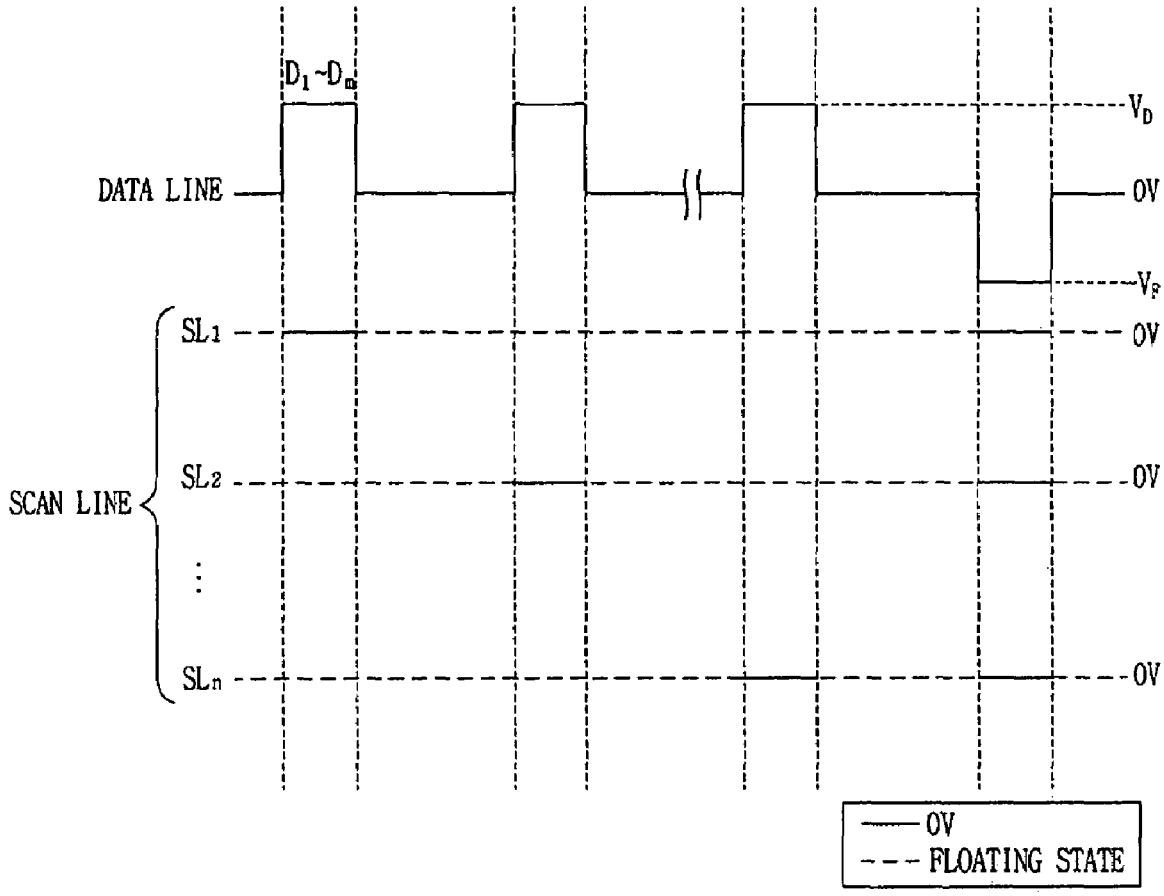
FIG. 7 is a waveform diagram showing a driving voltage generated from the driving apparatus of the electronic ink display device in accordance with the first embodiment for the driving apparatus of the electronic ink display device and a method therefor according to the present invention.

FIG. 7 is a waveform diagram showing a driving voltage generated from the driving apparatus of the electronic ink display device in accordance with a first embodiment for the driving apparatus of the electronic ink display device and a method therefor according to the present invention.

The driving method for the electronic ink display device according to the present invention comprises the steps of: applying a data pulse of a positive voltage $V_D$ to data lines connected to a cell to be driven among a plurality of data lines $D_1$~$D_m$; applying a ground voltage GND only to one scan line selected among scan lines $SL_1$~$SL_n$ in a floating state while the data pulse is applied to the data lines connected to the cell to be driven; performing those two steps for the non-selected scan lines, respectively, thereafter applying a frame reset pulse of a negative voltage $-V_F$ to all the plurality of data lines $D_1$~$D_m$; and applying the ground voltage GND to all of the scan lines $SL_1$~$SL_n$ while the frame reset pulse is applied.

Even though a power applied to the cell is cut off after data is displayed in a cell of the electronic ink display device, because potentials charged to the cell are not moved, the color pigment particles in the capsule maintain their current state and thus the data displayed in the cell is maintained as it is. Therefore, the frame reset pulse performs a function of leading the cell with the data displayed to a black state in order to display data for the next frame.

In the driving apparatus of the electronic ink display device, if one frame data to be driven is inputted from the external, each driving IC $IC_1$~$C_m$ of the data driving unit 300 outputs a data pulse to selected data lines of the electronic ink display panel 100. An operation of one data line will be explained in detail as follows. That is, a predetermined positive voltage $V_D$ is outputted to a data line by turning on the switching means $SW_a$ according to the switching control signal inputted from the external, then, after a predetermined time elapses, as soon as the switching means $SW_a$ is turned off, the switching means $SW_b$ and $SW_c$ are turned on to output a ground voltage GND to the data line, thereby applying a data pulse having the voltage level of $V_D$ to the data line during a predetermined time.

For instance, in order to drive cells connected to the first scan line $SL_1$ selectively, while a data pulse is selectively applied only to data lines connected to the cells to be driven, the switching means $SW_1$ of the scan driving unit 200 is turned on to apply the ground voltage GND only to the first scan line $SL_1$ among all the scan lines in a floating state. At this time, an electric field is formed by applying a predetermined positive voltage $V_D$ to cells connected even to data lines to which the data pulse has been selectively applied among the cells connected to the first scan line $SW_1$. Therefore, only the color pigment particles in the capsule of the cells having formed the electric field are moved to display data selectively in the cells positioned at the first scan line $SL_1$ of the electronic ink display panel 100.

Here, when the data pulse is applied to the selected data lines, because the other scan lines $SL_2$~$SL_n$ other than the first scan line $SL_1$ are all in the floating state, the electric field is never formed in cells connected to the other scan lines $SL_2$~$SL_n$. Therefore, unlike the passive driving method based on the conventional art, in the driving method for the electronic ink display device in accordance with the present invention, data is only displayed in the cell to be driven.

Furthermore, if the driving process performed for displaying data in the cells of the first scan line $SL_1$ is sequentially executed from the second scan line $SL_2$ to the last scan line $SL_n$, respectively, the electronic ink display panel 100 displays data with respect to one inputted frame in all the cells of the electronic ink display panel 100. Thereafter, in order to display data with respect to the next inputted frame, the electronic ink display device leads all the cells constructing the electronic ink display panel 100 to a black state.

The process to lead all the cells of the electronic ink display panel 100 to the black state comprises the steps of: simultaneously applying a frame reset pulse to all the data lines $D_1$~$D_m$ of the electronic ink display panel 100; and simultaneously applying the ground voltage GND to all the scan lines $SL_1$~$SL_n$ of the electronic ink display panel 100 while the frame reset pulse is simultaneously applied to all the data lines $D_1$~$D_m$ of the electronic ink display panel 100.

Here, it will be described about the process to lead all the cells of the electronic ink display panel 100 to the black state in detail as follows. First, after the electronic ink display panel 100 displays data for one frame, every switching means $SW_b$s and every switching means $SW_d$s of each driving IC $IC_1$~$IC_m$ are simultaneously turned on to apply a predetermined negative voltage $-V_F$ to all the data lines $D_1$~$D_m$. Then, after a predetermined time elapses, all the switching means $SW_d$s are turned off, and, in sequence, every switching means $SW_c$s of each driving IC $IC_1$~$C_m$ are simultaneously turned on to apply the ground voltage GND to all the data lines $D_1$~$D_m$. According to this, the frame reset pulse of a predetermined negative voltage $-V_F$ is applied to every data lines $D_1$~$D_m$ during a predetermined time. Then, while the frame reset pulse is applied to every data lines $D_1$~$D_m$, every switching means $SW_1$~$SW_n$ of the scan driving unit 200 are turned on to apply the ground voltage GND to every scan lines $SL_1$~$SL_n$. Therefore, the electric field to reset is formed in every cells of the electronic ink display panel 100, so that the color pigment particles in the capsule within all the cells are moved in the opposite direction of the case for the data driving. As a result of this, all the cells lie in a black state.

Hereinafter, it will now be explained of a second preferred embodiment for a driving apparatus of an electronic ink display device and a method therefor in accordance with the present invention with reference to FIGS. 8 to 10.

Figure 8:
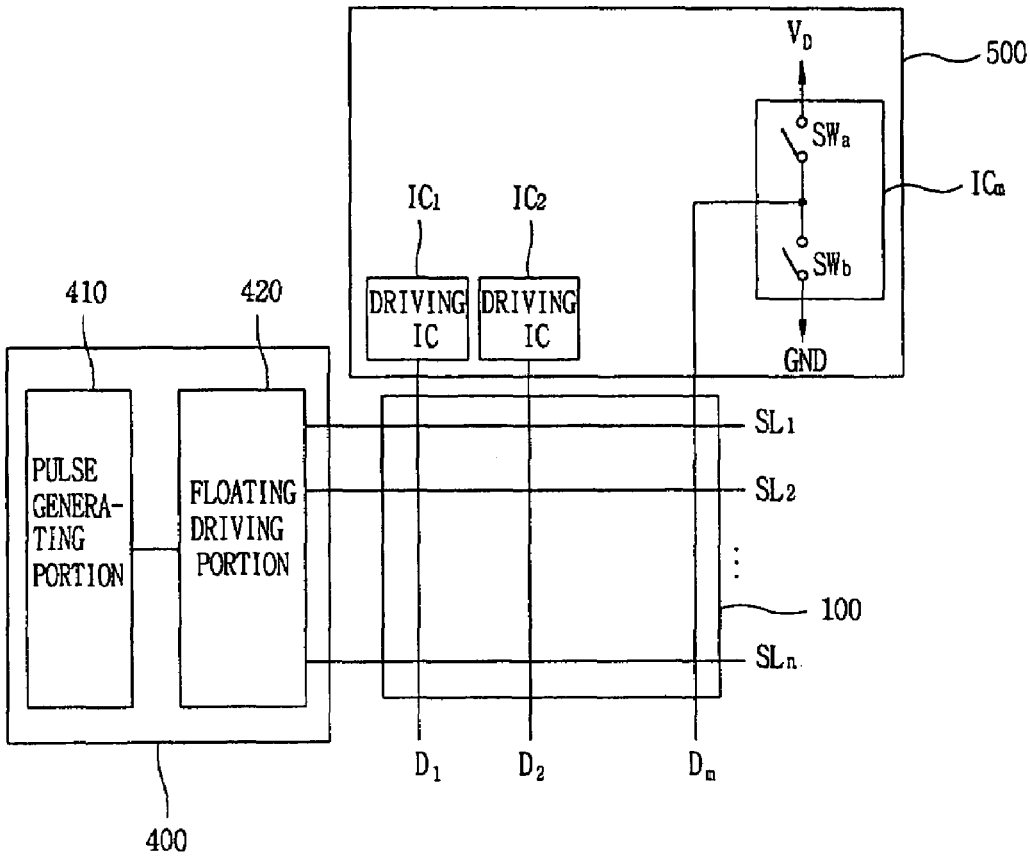
FIG. 8 is a schematic diagram showing a driving apparatus of an electronic ink display device in accordance with a second embodiment for the driving apparatus of the electronic ink display device and a method therefor according to the present invention.

Referring to FIG. 8, the driving apparatus of the electronic ink display device in accordance with the present invention is comprised of: an electronic ink display panel 100 including a plurality of data lines $D_1$~$D_m$ and a plurality of scan lines $SL_1$~$SL_n$, and cells of the electronic ink display device being respectively placed at positions where the plurality of data lines $D_1$~$D_m$ and the plurality of scan lines $SL_1$~$SL_n$ perpendicularly are perpendicularly crossed to each other; a scan driving unit 400 applying a scan pulse of a predetermined negative voltage $-V_S$, a scan line reset pulse of a first predetermined positive voltage $V_r$, or a frame reset pulse of a second predetermined positive voltage $V_F$ only to a scan line selected among the plurality of scan lines $SL_1$~$SL_n$ in a floating state; and a data driving unit 500 having a plurality of driving ICs $IC_1$~$IC_m$ therein which are constructed by including two switching means $SW_a$ and $SW_b$, and applying a data pulse of a third predetermined positive voltage $V_D$ to the plurality of data lines $D_1$~$D_m$.

Figure 9:
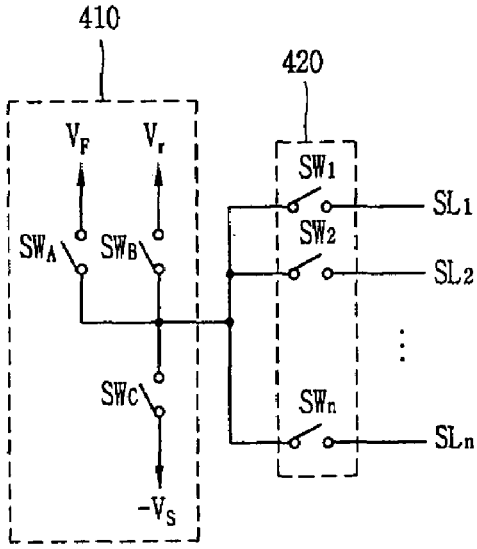
FIG. 9 is a schematic diagram showing a scan driving unit 400 shown in FIG. 8 in detail.

FIG. 9 is a schematic diagram showing the scan driving unit 400 shown in FIG. 8 in detail.

Referring to FIG. 9, the scan driving unit 400 includes: a pulse generating portion 410 having a plurality of switching means $SW_A$~$SW_C$ therein for outputting a scan pulse, a scan line reset pulse or a frame reset pulse to a floating driving portion 420 according to a control signal (not shown) inputted from the external; and the floating driving portion 420 having a plurality of switching means $SW_1$~$SW_n$ therein, and applying the scan pulse, the scan line reset pulse or the frame reset pulse outputted from the pulse generating portion 410 only to a scan line selected among the plurality of scan lines $SL_1$~$SL_n$ in a floating state according to the control signal (not shown) from the external.

The pulse generating portion 410 outputs the scan pulse of a predetermined negative voltage $-V_S$ or outputs the scan line reset pulse of a first predetermined positive voltage $V_r$ or the frame reset pulse of a second predetermined positive voltage $V_F$ while the data driving unit 500 applies a data pulse of a third predetermined positive voltage $V_D$ to the plurality of data lines $D_1$~$D_m$. On the other hand, the floating driving portion 420 comprises the plurality of switching means $SW_1$~$SW_n$ to apply one of the scan pulse, the scan line reset pulse or the frame reset pulse outputted from the pulse generating portion 410 to a scan line selected among the plurality of scan lines $SL_1$~$SL_n$ in a floating state.

Here, a plurality of switching means (namely, the plurality of switching means $SW_A$~$SW_C$ and the plurality of switching means $SW_1$~$SW_n$) included in the pulse generating portion 410 and the floating driving portion 420 are turned on/off according to a switching control signal generated from a controller (not shown) constructed outside. Because the switching control signal applied to each switching means $SW_1$~$SW_n$ of the floating driving portion 420 are basically in a state that an off-switching control signal is inputted, every scan lines $SL_1$~$SL_n$ basically become a floating state. Also, because the floating driving portion 420 inputs an on-switching control signal according to an external switching control signal (not shown) only to one selected switching means, and inputs the off-switching control signal after a predetermined time elapses, a pulse of a voltage outputted from the pulse generating portion 410 is applied only to a scan line connected to the one selected switching means.

Now, it will be explained of an operation of the driving apparatus of the electronic ink display device and the method therefor in accordance with the present invention with reference to FIGS. 8 to 10 in detail.

Figure 10:
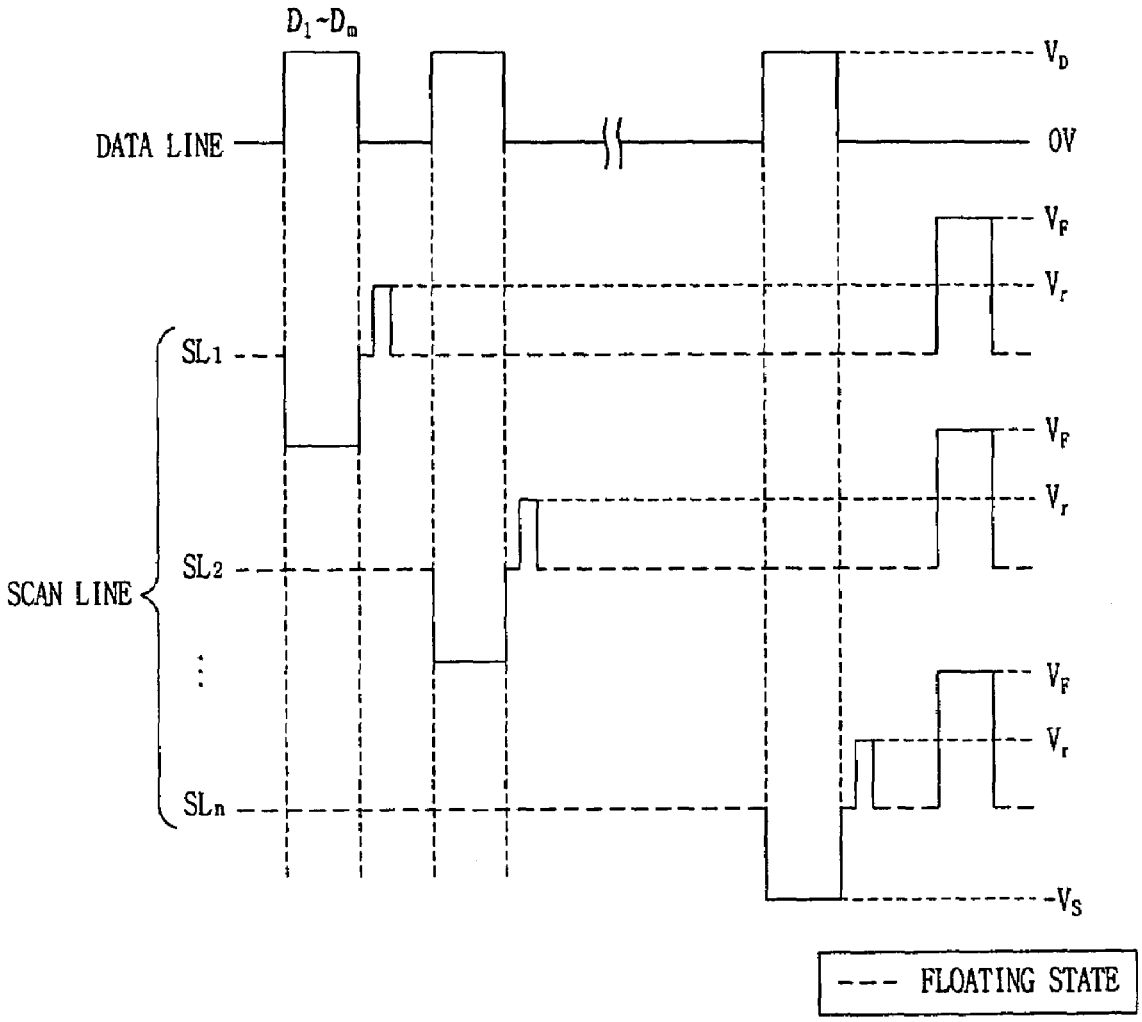
FIG. 10 is a waveform diagram showing a driving voltage generated from the driving apparatus of the electronic ink display device in accordance with the second embodiment for the driving apparatus of the electronic ink display device and a method therefor according to the present invention.

FIG. 10 is a waveform diagram showing a driving voltage generated from the driving apparatus of the electronic ink display device in accordance with a second embodiment for the driving apparatus of the electronic ink display device and the method therefor according to the present invention.

The method for driving the electronic ink display device comprises the steps of: applying a data pulse of a first predetermined positive voltage $V_D$ to data lines connected to a cell to be driven among a plurality of data lines $D_1$~$D_m$; applying a scan pulse of a predetermined negative voltage $-V_S$ only to a scan line selected among scan lines $SL_1$~$SL_n$ in a floating state while the data pulse is applied to the data lines connected to the cell to be driven, and thereafter applying a scan line reset pulse of a second predetermined positive voltage $V_r$; and performing the above two steps for non-selected scan lines, and thereafter applying a frame reset pulse of a third predetermined positive voltage $V_F$ to all the plurality of scan lines $SL_1$~$SL_n$.

Even though a power applied to the cell is cut off after displaying data in a cell of the electronic ink display device, because potentials charged to the cell are not moved, color pigment particles in the capsule maintain their current state, and thus the data displayed in the cell are maintained as it is. Therefore, the scan line reset pulse leads the cells displaying the current data to a black state to facilitate a frame reset, thereby improving a contrast of the electronic ink display panel 100. The frame reset pulse performs a function for leading the electronic ink display panel 100 to the black state in order to display data of a frame to be inputted next. Here, the scan line reset pulse establishes a voltage level to be applied and a time to apply the voltage as much as the voltage does not have any influence on adjacent scan lines. Also, because the electronic ink display device delays a response time in its characteristics, the frame reset pulse provides a voltage by allowing it to be a higher level and a time to apply it to be longer, thereby improving the contrast of the electronic ink display panel 100 and raising the response speed of a cell. That is, the voltage level $V_F$ of the frame reset pulse is greater than the voltage level $V_r$ of the scan line reset pulse, and the pulse width of the frame reset pulse is wider than that of the scan line reset pulse.

In the driving apparatus of the electronic ink display device, if data for one frame to be driven is inputted from the external, each driving IC $IC_1$~$IC_m$ of the data driving unit 300 outputs a data pulse to selected data lines of the electronic ink display panel 100. An operation of one data line will now be described in detail. That is, a switching means $SW_a$ is turned on according to a switching control signal inputted from the external to output a first predetermined positive voltage $V_D$ to a data line, and after a predetermined time elapses, as soon as the switching means $SW_a$ is turned off, a switching means $SW_b$ is turned on. Thereafter, a ground voltage GND is outputted to the data line. According to this, a data pulse having a voltage level of $V_D$ is applied to the data line during the predetermined time.

For instance, in order to selectively drive cells connected to the first scan line $SL_1$, while the data pulse is selectively applied only to data lines connected to cells to be driven, the switching means $SW_C$ of the pulse generating portion 410 and the switching means $SW_1$ of the floating driving portion 420 are turned on to apply a scan pulse having a voltage level of $-V_S$ only to the first scan line $SL_1$ among all the scan lines $SL_1$~$SL_n$ in a floating state. At this time, a potential difference corresponding to $V_D+V_S$ is generated in cells connected even to the data lines to which the data pulse has been selectively applied among the cells connected to the first scan line $SL_1$, thereby forming an electric field. Therefore, only the color pigment particles in the capsule of the cells in which the electric field has been formed are moved to display data selectively in cells placed at the first scan line $SL_1$ of the electronic ink display panel 100.

Likely in the first preferred embodiment, when the data pulse is applied to the selected data lines and the scan pulse is applied to the first scan line $SL_1$, because the remaining scan lines $SL_2$~$SL_n$ other than the first scan line $SL_1$ are all in a floating state, the electric field is never formed in cells connected to the remaining scan lines $SL_2$~$SL_n$. Therefore, unlike in the passive driving method based on the conventional art, in the driving method for the electronic ink display device in accordance with the present invention, data is displayed only in the cell to be driven.

Thereafter, after displaying data by applying the scan pulse to the cells of the first scan line $SL_1$, in order to lead the cells to a black state (namely, a state without any data displayed), the ground voltage GND is applied to all the data lines $D_1$~$D_m$ as soon as the scan line reset pulse is applied to the first scan line $SL_1$. That is, while a ground voltage 0V is applied to all the data lines $D_1$~$D_m$, the switching means $SW_B$ of the pulse generating portion 410 and the switching means $SW_1$ of the floating driving portion 420 are simultaneously turned on. After a predetermined time elapses the two switching means are simultaneously turned off. As a result of this, the reset pulse of a second predetermined positive voltage $V_r$ is applied to the first scan line $SL_1$.

As described through above examples, if the driving process performed for displaying data in the cells of the first scan line $SL_1$ is sequentially executed from the second scan line $SL_2$ to the last scan line $SL_n$, respectively, the electronic ink display panel 100 displays the data with respect to one inputted frame in all the cells of the electronic ink display panel 100. Then, the electronic ink display device leads all the cells constructing the electronic ink display panel 100 to the black state in order to display data for a frame to be inputted next. The process to lead all the cells constructing the electronic ink display panel 100 to the black state is identical to the frame reset process described in the first preferred embodiment.

The process to lead all the cells constructing the electronic ink display panel 100 to the black state includes the steps of: simultaneously applying the ground voltage GND to all the data lines $D_1$~$D_m$ of the electronic ink display panel 100; and simultaneously applying the frame reset pulse to all the scan lines $SL_1$~$SL_n$ of the electronic ink display panel 100 while the ground voltage GND is simultaneously applied to all the data lines $D_1$~Dm of the electronic ink display panel 100.

Here, the process to lead all the cells constructing the electronic ink display panel 100 to the black state will now be described in detail. First, after the electronic ink display panel 100 displays the data for one frame, while every switching means $SW_b$s of each driving IC $IC_1$~$IC_m$ in the data driving unit 500 are turned on to apply the ground voltage GND to all the data lines $D_1$~$D_m$, the switching means $SW_A$ of the pulse generating portion 410 and all the switching means $SW_1$~$SW_n$ of the floating driving portion 420 are simultaneously turned on. After a predetermined time (namely, a time as long as all the cells can be led to the black state) elapses, the switching means $SW_A$ and all the switching means $SW_1$~$SW_n$ are turned off to apply the frame reset pulse of a $V_F$ voltage level to all the scan lines $SL_1$~$SL_n$. Therefore, since a potential difference corresponding to $V_F$ is generated in all the cells of the electronic ink display panel 100 to form an electric field, color pigment particles in the capsule within all the cells are moved in the opposite direction of the case for the data driving. As a result of this, all the cells lie in a black state.

As stated above, in the passive matrix type electronic ink display device, a potential difference is generated in only the cell to display data, thereby forming an electric field, and the remaining cells not to display data are floated. According to this, it is effective to drive the electronic ink display device precisely.

According to the first preferred embodiment of the present invention, the passive matrix type electronic ink display device can be effectively and precisely driven by applying a data pulse to at least one data line among a plurality of data lines, applying a ground voltage to only one scan line selected among a plurality of scan lines while the data pulse is applied, simultaneously applying a reset pulse to the plurality of data lines, and simultaneously applying the ground voltage to the plurality of scan lines while the reset pulse is applied.

Additionally, according to the second preferred embodiment of the present invention, in the passive matrix type electronic ink display device, a data pulse is applied to at least one data line among a plurality of data lines, a scan pulse is applied only to one scan line selected among a plurality of scan lines while the data pulse is applied, then, a scan line reset pulse is applied to the scan line to which the scan pulse has been applied, thereafter, a ground voltage is applied to the plurality of data lines, and then a frame reset pulse is simultaneously applied to the plurality of scan lines while the ground voltage is simultaneously applied to the plurality of data lines, thereby driving the passive matrix type electronic ink display device precisely, improving a contrast thereof, and also improving an image quality by equalizing the state of cells.

Furthermore, according to the second preferred embodiment of the present invention, when displaying data, because a positive voltage is applied to data lines and negative voltage to scan lines, a voltage applied to a driving IC is segmented and then applied, thereby lowering the voltage applied to the driving IC. According to this, a life span of the driving IC can be prolonged.

Also, because an image quality of the electronic ink display device can be improved by manufacturing a passive matrix type electronic ink display device, not an active matrix type one, its manufacturing process can be simplified.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A driving method for an electronic ink display device, comprising:

applying a data pulse to at least one data line among a plurality of data lines, and applying a ground voltage or a scan pulse only to one scan line selected among a plurality of scan lines while the data pulse is applied, wherein scan lines that are not selected assume a floating state while the ground voltage or scan pulse is applied only to the selected scan line; and simultaneously applying a frame reset pulse to the plurality of data lines and simultaneously applying the ground voltage to the plurality of scan lines while the frame reset pulse is applied, or applying the frame reset pulse to the plurality of scan lines and simultaneously applying the ground voltage to the plurality of data lines while the frame reset pulse is applied.

2. The driving method of claim 1, wherein the data pulse is applied only to the data line selected among the plurality of data lines.

3. The driving method of claim 1, further comprising:

applying the ground voltage or the scan pulse to the one selected scan line, and then applying a scan line reset pulse to the scan line to which the ground voltage or the scan pulse has been applied; and simultaneously applying the ground voltage to the plurality of data lines while the scan line reset pulse is applied.

4. The driving method of claim 3, wherein the data pulse is a pulse of a positive voltage, the scan pulse is a pulse of a negative voltage; the scan line reset pulse is a pulse of a positive voltage, and the frame reset pulse is a pulse of a negative voltage when applying to the plurality of data lines and a pulse of a positive voltage when applying to the plurality of scan lines.

5. The driving method of claim 4, wherein the frame reset voltage is applied for a longer dine than the scan line reset pulse when applying to the plurality of scan lines, and the size of the frame reset voltage is greater than the size of the scan line reset pulse.

6. The driving method of claim 1, wherein the floating state causes a potential difference between the unselected scan lines and the data lines to be substantially zero.

7. A driving method for an electronic ink display device, comprising:

applying a data voltage to at least one data line among a plurality of data lines; and applying a scan voltage only to one scan line selected among a plurality of scan lines while the data voltage is applied, wherein scan lines that are not selected assume a floating state while the scan voltage is applied only to the selected scan line.

8. The driving method of claim 7, wherein the data voltage is applied only to a data line selected among the plurality of data lines.

9. The driving method of claim 7, further comprising:

simultaneously applying a frame reset voltage to the plurality of data lines; and simultaneously applying a ground voltage to the plurality of scan lines while the frame reset voltage is applied.

10. The driving method of claim 9, wherein the data voltage is a positive voltage, the scan voltage is a ground voltage (GND), and the frame reset voltage is a negative voltage.

11. The driving method of claim 7, further comprising:

applying a scan voltage only to one selected scan line, and then applying a scan line reset voltage to a scan line to which the scan voltage has been applied; and simultaneously applying a ground voltage to the plurality of data lines while the scan line reset voltage is applied.

12. The driving method of claim 11, further comprising:

applying a frame reset voltage to the plurality of scan lines; and simultaneously applying a ground voltage to the plurality of data lines while the frame reset voltage is applied.

13. The driving method of claim 12, wherein the data voltage is a positive voltage, the scan voltage is a negative voltage, the scan line reset voltage is a positive voltage, and the frame reset voltage is a positive voltage.

14. The driving method of claim 13, wherein the frame reset voltage is applied for a longer time than the scan line reset voltage and the size of the frame reset voltage is greater than the size of the scan line reset voltage.

15. The driving method of claim 7, wherein the floating state causes a potential difference between the unselected scan lines and the data lines to be substantially zero.

16. The driving method of claim 7, wherein the scan voltage applied only to the selected scan line is substantially a ground voltage and wherein the data voltage applied to the at least one data line is a positive voltage.

17. The driving method of claim 7, further comprising:

applying a reset voltage to the selected scan line, wherein the reset voltage is applied after the scan voltage is applied to the selected scan line and before a scan voltage is applied to another one of the plurality of scan lines.

18. A driving method for an electronic ink display device, comprising:

applying a data pulse to at least one data line among a plurality of data lines, and applying a ground voltage only to one scan line selected among a plurality of scan lines while the data pulse is applied wherein scan lines that are not selected assume a floating state while the ground voltage is applied only to the selected scan line; and simultaneously applying a frame reset pulse to the plurality of data lines, and simultaneously applying a ground voltage to the plurality of scan lines while the frame reset pulse is applied.

19. The driving method of claim 18, wherein the data pulse is applied only to the data line selected among the plurality of data lines.

20. The driving method of claim 18, wherein the data pulse is a pulse of a positive voltage and the frame reset pulse is a pulse of a negative voltage.

21. The driving method of claim 1, wherein the floating state causes a potential difference between the unselected scan lines and the data lines to be substantially zero.

22. A driving method for an electronic ink display device, comprising:

applying a data pulse to at least one data line among a plurality of data lines, and applying a scan pulse only to one scan line selected among a plurality of scan lines while the data pulse is applied;

applying a ground voltage or the scan pulse only to the one selected scan line, thereafter, applying the ground voltage to the plurality of data lines simultaneously, and then applying a scan line reset pulse to the scan line to which the scan pulse has been applied while the ground voltage is applied; and applying a frame reset pulse to the plurality of scan lines, and then simultaneously applying the ground voltage to the plurality of data lines while the frame reset pulse is applied.

23. The driving method of claim 22, wherein in applying the data pulse to at least one data line among the plurality of data lines, and applying the scan pulse only to one scan line selected among the plurality of scan lines while the data pulse is applied, when applying the scan pulse only to one scan line selected among the plurality of scan lines, the remaining scan lines other than the selected scan line become a floating state.

24. The driving method of claim 22, wherein the data pulse is applied only to the data line selected among the plurality of data lines.

25. The driving method of claim 22, wherein the data pulse is a pulse of a positive voltage, the scan pulse is a pulse of a negative voltage, the scan line reset pulse is a pulse of a positive voltage, and the frame reset pulse is a pulse of a positive voltage.

26. The driving method of claim 25, wherein the frame reset pulse is applied for a longer time than the scan line reset pulse and the size of the frame reset pulse is greater than the size of the scan line reset pulse.

27. A driving apparatus of an electronic ink display device, comprising:

an electronic ink display panel constructed by in chiding a plurality of data lines and a plurality of scan lines;

a scan driving unit applying a ground voltage only to a scan line selected among the plurality of scan lines; and a data driving unit applying a data pulse of a predetermined positive voltage, a ground voltage, or a frame reset pulse of a predetermined negative voltage to the plurality of data lines, wherein the scan driving unit includes a plurality of switches each controlled by a switching control signal, the scan driving unit applying the ground voltage through one of said switches only to the selected scan line during a predetermined time and controlling the scan lines that are not selected to assume a floating state while the ground voltage is applied only to the selected scan line.

28. The driving apparatus of claim 27, wherein the data driving unit includes driving ICs having a plurality of switches therein controlled by a switching control signal, the data driving unit applying a data pulse of a predetermined positive voltage, a ground voltage or a frame reset pulse of a predetermined negative voltage to the data lines of the electronic ink display panel according to the switching control signal.

29. The driving apparatus of claim 27, wherein the switching control signal floats the unseleted scan lines when a voltage is not applied to the unselected scan lines of the electronic ink display panel.

30. The driving apparatus of claim 27, wherein the floating state causes a potential difference between the unselected scan lines and the data lines to be substantially zero.

31. A driving apparatus of an electronic ink display device, comprising:

an electronic ink display panel constructed by including a plurality of data lines and a plurality of scan lines;

a data driving unit applying a data pulse of a predetermined positive voltage or a ground voltage to the plurality of data lines; and a scan driving unit applying a scan pulse of a predetermined negative voltage, a scan line reset pulse of a fast predetermined positive voltage, or a frame reset pulse of a second predetermined positive voltage only to a scan line selected among the plurality of scan lines, wherein the scan driving unit includes a plurality of switches controlled by a switching control signal, and applies the ground voltage only to the selected scan line during a predetermined time according to the switching control signal, and floats the remaining scan lines other than the selected scan line.

32. The driving apparatus of claim 31, wherein the data driving unit includes driving ICs having a plurality of switches therein controlled by a switching control signal, and applies a data pulse of a predetermined positive voltage or a ground voltage to data lines of the electronic ink display panel according to the switching control signal.

33. The driving apparatus of claim 31, wherein the scan driving unit comprises:

a pulse generating portion having a plurality of switches therein controlled by a switching control signal and outputting a scan pulse, a scan line reset pulse or a frame reset pulse to a floating driving portion according to the switching control signal; and the floating driving portion having a plurality of switches controlled by a switching control signal, applying the scan pulse, the scan line reset pulse or the frame reset pulse outputted from the pulse generating portion to a selected scan line during a predetermined time according to the switching control signal, and then floating the remaining scan lines other than the selected scan line.

34. The driving apparatus of claim 33, wherein the switching control signal floats the plurality of scan lines when a voltage is not applied to scan lines of the electronic ink display panel.

35. The driving apparatus of claim 31, wherein the floating state causes a potential difference between the unselected scan lines and the data lines to be substantially zero.

* * * * *